United States Patent [19]

Bridges et al.

[11] Patent Number: 4,616,206

[45] Date of Patent: Oct. 7, 1986

[54] CIRCUIT BREAKER AND SHUNT TRIP APPARATUS COMBINED WITHIN SINGLE POLE DEVICE

[75] Inventors: Robert B. Bridges, Elm Grove; John R. Brubaker, Milwaukee, both of Wis.

[73] Assignee: Eaton Corporation, Cleveland, Ohio

[21] Appl. No.: 648,240

[22] Filed: Sep. 7, 1984

[51] Int. Cl.[4] ..... H01H 71/16; H01H 61/08

[52] U.S. Cl. ..... 337/71; 337/70; 337/140; 335/14; 335/43

[58] Field of Search ..... 337/71, 70, 75, 77, 337/140; 335/14, 20, 43

[56] References Cited

U.S. PATENT DOCUMENTS

| | | | |
|---|---|---|---|
| 2,154,703 | 9/1935 | Sandin | 335/8 |
| 3,081,386 | 3/1963 | Koenig et al. | 335/9 |
| 3,256,407 | 6/1966 | Klein | 335/173 |
| 3,324,428 | 6/1967 | Shaffer | 335/20 |
| 3,436,695 | 4/1969 | Dessert | 335/9 |
| 3,820,046 | 6/1974 | Layton et al. | 335/13 |
| 3,973,230 | 8/1976 | Ciarcia et al. | 335/13 |
| 4,167,716 | 9/1979 | Horn | 335/14 |
| 4,205,293 | 5/1980 | Melton et al. | 337/140 |
| 4,209,761 | 6/1980 | Klein et al. | 335/17 |
| 4,434,413 | 2/1984 | Pelletier et al. | 337/71 |

*Primary Examiner*—Harold Broome

*Attorney, Agent, or Firm*—C. H. Grace; L. G. VandeZande

[57] ABSTRACT

A molded case circuit breaker wherein a movable contact arm (8) is operated between open and closed positions with a stationary contact (4*b*) by an operating mechanism which controls an overcenter toggle drive spring (12) and which is automatically openable upon sensing overload conditions by releasing a latched lever (10) for carrying the line of action of the drive spring (12) across the pivot (8*a*) of the movable contact arm (8). The current sensing trip means (16) for unlatching the latched lever (10) is formed of a shape memory effect alloy to provide a significant amount of travel of the latching end thereof in response to a narrow band of current thereby to insure release of the latch lever (10) without need for calibrating the breaker. The shape memory effect element (16) is affixed at one end to a heater strap (18) for indirect heating by current flow in the distribution circuit and is provided with a flexible conductor (30) attached at its opposite end and connected with a electric power source through a remote control apparatus (32) and a current limiting resistor (34) for effecting selective direct heating of the SME element to selectively operate the breaker to its tripped position from the remote location.

32 Claims, 1 Drawing Figure

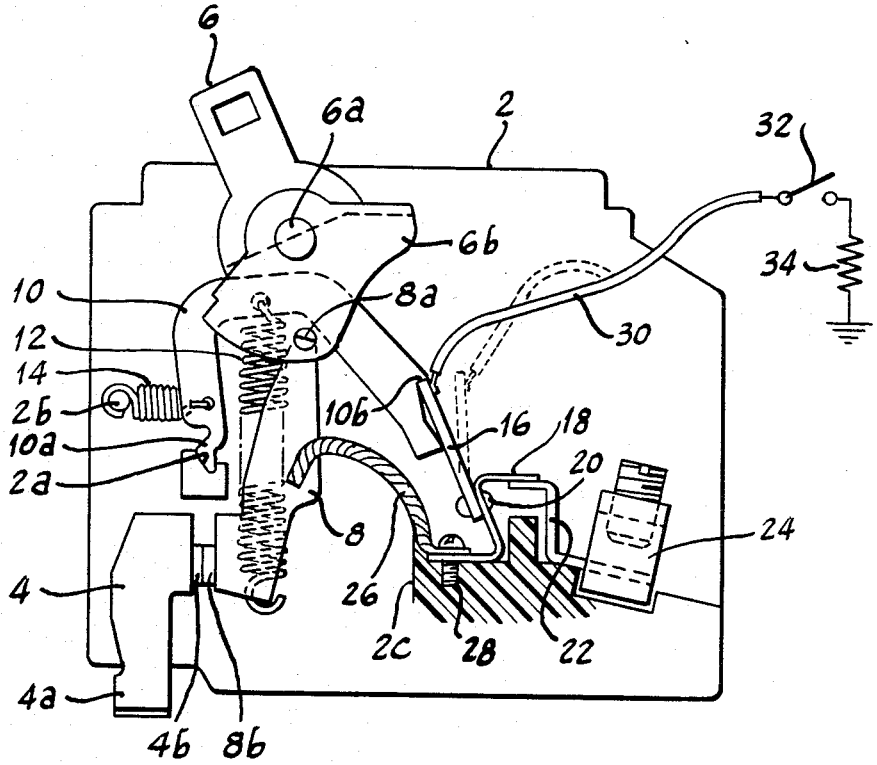
6
6a
2
32
6b
34
10
8a
12
30
14
2b
10b
16
18
10a
20
2a
8
24
4
26
2c
28
22
4a
4b
8b

CIRCUIT BREAKER AND SHUNT TRIP APPARATUS COMBINED WITHIN SINGLE POLE DEVICE

CROSS-REFERENCE TO RELATED APPLICATION

This application is related to copending application titled "Calibrationless Electric Circuit Breaker", Ser. No. 648,397 filed Sept. 7, 1984 in the name of John R. Brubaker et al, and assigned to the assignee of this application.

BACKGROUND OF THE INVENTION

This invention relates to molded case circuit breakers of the type for protecting against overload current conditions in electric distribution circuits. More specifically, this invention relates to circuit breakers of the aforementioned type which have a shunt trip mechanism for operation of the circuit breaker to a tripped condition from a remote location.

It has been known to provide circuit breakers of the aforementioned type with a shunt trip apparatus for enabling the breaker to be selectively operated to its tripped condition from a remote location. The shunt trip feature is commonly provided by adding a separate molded case enclosure to the side of an existing molded case circuit breaker, the separate enclosure containing the shunt trip elements such as a solenoid and a lever system which is coupled to the circuit breaker through a handle tie or through openings in the respective side walls of the molded cases. Shunt trip circuit breakers of the narrow width residential or small commercial frame type constructed in this manner occupy two pole spaces on a panelboard to which the circuit breaker is mounted, one space being required for the circuit breaker per se and the second space being required for the shunt trip mechanism. Thus, for each shunt trip breaker device of this type utilized, one pole space for a protected branch circuit is sacrificed. U.S. Pat. Nos. 4,209,761, 3,973,230 and 3,820,046 are examples of shunt trip circuit breakers of the aforementioned type.

The aforementioned related copending application Ser. No. 648,397 filed Sept. 7, 1984 discloses a circuit breaker which utilizes a shape memory effect (SME) alloy element as a current responsive trip mechanism for responding to both high and low current level overload conditions. Such structure replaces separate thermal current sensing and latch structures and may replace magnetic current sensing structures within the circuit breaker, thereby substantially reducing the number of parts, the cost, and the occupied space within the circuit breaker housing. The SME element is also utilized advantageously to eliminate calibration operations of the circuit breaker during manufacture. In accordance with this invention, the SME element is further utilized as a shunt trip mechanism and may be readily incorporated within the same housing as the circuit breaker structure.

SUMMARY OF THE INVENTION

The invention described herein provides a molded case circuit breaker of the type which is manually operable between open and closed contact positions and automatically operable in response to overload current conditions to open the contacts, such breaker being provided with a shunt trip mechanism incorporated within the single pole molded case of the circuit breaker. More specifically, this invention provides a circuit breaker mechanism of a type suitable for use in a molded case circuit breaker embodiment having an overcenter toggle spring drive for a movable contact, an operator for controlling the toggle spring drive to manually operate the movable contact between open and closed position with respect to a stationary contact, a releasable latching member which, in its latched condition, enables the overcenter toggle spring drive and operator mechanism for manual control of the movable contact and which, in its unlatched condition, causes the overcenter toggle spring drive to move the movable contact to an open position independently of the manual operator, a current sensitive trip structure comprising a shape memory effect (SME) element for restraining the latch member in its latched condition and for releasing the same in response to predetermined current levels, and shunt trip apparatus housed within the molded case of the circuit breaker which is selectively operable from a remote location for effecting operation of the SME trip means for selectively releasing the latching member.

A more complete understanding of the invention will be had from the following description and claims when read in conjunction with the accompanying drawing.

BRIEF DESCRIPTION OF THE DRAWING

The single FIGURE of the drawing is a schematic representation of a circuit breaker constructed in accordance with this invention.

DESCRIPTION OF THE PREFERRED EMBODIMENT

Referring to the drawing, a circuit breaker of the residential and commercial frame molded case type such as that disclosed in U.S. Pat. No. 3,081,386 to M. F. Koenig et al, the disclosure of which is hereby incorporated in this disclosure by reference, is shown in a schematic manner. The circuit breaker comprises a molded insulating housing represented by the outline 2. A stationary contact assembly 4 is positioned within the housing at the lower left-end corner thereof, the stationary contact assembly having a terminal portion **4*a* projecting outwardly of the bottom of the circuit breaker housing 2 for connection with an electrical power distribution circuit and having a stationary contact element 4*b* secured to an internal face thereof. An operator handle 6 is journaled for rotation within the housing 2 about trunnions 6*a* (only one shown). Operator 6 has a flange 6*b* depending along the forward surface with respect to the plane of the drawing and has a similar flange disposed along the rearward surface thereof to form an open channel therebetween. A movable contact arm 8, also formed as a channel, has outwardly projecting ears 8*a* adjacent the upper ends of forward and rearward respective legs. The ears 8*a* are received within holes formed in the flanges 6*b* of operator 6 to pivotally support the movable contact arm from the operator handle 6. A movable contact element 8*b* is secured to a lower face of the movable contact arm 8 to mutually engage with contact element 4*b* of stationary contact assembly 4. An inverted U-shaped latch lever 10 is pivotally supported within the housing 2. Latch lever 10 has a foot portion 10*a* formed at the lower end of left-hand leg as viewed in the drawing which rests within a suitable support recess 2*a* formed in the housing to serve as the pivotal support for the latch lever 10**.

The bight portion of latch lever 10 is disposed between the flanges 6b of operator 6 and between the legs of movable contact arm 8. The right-hand leg of latch lever 10 is provided with a notched latching surface 10b. A helical spring 12 is connected in tension between the bight portion of latch lever 10 and the unsupported lower end of movable contact arm 8. A second helical spring 14 is connected in tension between the left-hand leg of latch lever 10 and a post 2b formed in the housing 2.

A current sensing trip member 16 is rigidly affixed to a heater strip 18 by a rivet 20 or the like. Heater 18 is electrically affixed to a conductor 22 such as by brazing, soldering, welding or the like, the conductor strip 22 being received within a pressure type wiring terminal 24 which receives a conductor from an electrical distribution circuit in which the circuit breaker is to provide overcurrent protection. The opposite end of heater strip 18 is connected to one end of a flexible braided conductor 26 which is attached by soldering, brazing or the like at its other end to the movable contact arm 8. A screw 28 serves to connect heater strip 18 and conductor 26 and to secure the heater strip 18 to the housing 2. When the circuit breaker is connected into an electrical distribution circuit such as by plugging it into a panelboard and connecting the wires of the distribution circuit thereto, a circuit will exist within the circuit breaker from terminal 24 through conductor 22, heater 18, braided conductor 26, movable contact arm 8, movable contact 8b, stationary contact 4b and stationary contact terminal 4a to the other side of the power distribution circuit.

A second flexible conductor such as wire 30 is electrically attached by welding, brazing or the like to the end of trip member 16 at a point near the engagement thereof with latch lever 10. Wire 30 is brought outside the circuit breaker housing 2 and is connected to one side of a remote control apparatus which may be a manual switch or a condition sensing switch operable upon some input, either manual, mechanical or electrical, to complete a circuit through the supply side of the distribution circuit, connector 24, conductor 22, the top portion of heater 18, and through the element 16, wire 30 and control apparatus 32 and through a current limiting resistor 34 to ground. The current limiting resistor 34 limits the amount of current drawn by this pilot control circuit.

When the current sensing trip structure 16 is in the latching position shown in the drawing, the unsupported end thereof directly engages the latching surface 10b of latch lever 10 to restrain the latch lever in the position shown. In this position, the operating mechanism for the circuit breaker is enabled whereby movable contact arm 8 is manually controllable by operator 6. Manual rotation of operator 6 to the right causes the pivotal support ears 8a of the movable contact arm 8 to move leftward across the line of action of overcenter drive spring 12, thereby causing a toggling action of the movable contact arm to separate the contacts 4b and 8b with a snap-action. The housing 2 may be provided with a suitable stop 2c for arresting the opening movement of the movable contact arm 8. Manual rotation of operator 6 from the right-hand position back to the left-hand position shown in the drawings will rotate the pivotally supported end 8a of the movable contact arm 8 back across the line of action of the overcenter drive spring 12 to cause toggling action of the free end of movable contact arm 8 to thereby cause the contacts 8b to close upon stationary contact 4b.

Although not limited thereto, the current sensing trip means 16 is preferably formed from a shape memory effect (SME) alloy. Elements made from such alloys may be formed to a shape which is to be remembered by the element, heat treated to cause the element to remember that shape, and then formed to an intermediate shape. The element 16 as shown in the drawing has a memory shape which is warped to the right as represented by the dotted lines in the drawing, and is formed as a flat member in its intermediate shape. When the element 16 is heated to a temperature above a predetermined transition range for the SME material, the element changes abruptly to its memory configuration. This change occurs with significant force, relatively rapidly and provides a large degree of movement for a relatively narrow temperature band. As described in the aforementioned related application, the element 16 is formed to have a significant amount of movement from its intermediate shape to its memory shape, such movement being considerably in excess of the amount of movement required to release the latch lever 10. By so forming the element 16, calibration of the circuit breaker at the factory during and after the assembly thereof is not required.

In the event that overload current conditions are present in the distribution circuit, such currents will generate heat in the heater strip 18 so as to cause indirect heating of the SME element 16. When heated to its transition temperature, the element 16 warps to its right-hand or dotted line position, to release the latch lever 10. Spring 12 coacting between the lower end of movable contact arm 8 and the bight of latch lever 10 moves the latch lever 10 clockwise above the support point 2a. Such movement carries the line of action of overcenter toggle spring 12 across the axis of pivotal support 8a of the movable contact arm, thereby causing the latter to toggle open with a snap-action.

The element 16 is preferably formed to be a two-way SME alloy whereby upon cooling of the element below the transition temperature it returns to the intermediate flat shape in which it is in position to engage latching surface 10b and latch the latch lever 10. Alternatively, a spring may be employed between a suitable formation in the housing 2 and the element 16 to bias the element 16 to its intermediate flat condition upon cooling thereof if the element is not otherwise formed to be a two-way element. Once the SME element is cooled and in its intermediate position, the circuit breaker may be reset by operating the handle 6 fully to the right-hand position so as to relax the spring 12 to its greatest amount whereupon the spring 14 provides a counterclockwise rotation to the latch lever 10 to cause the right-hand leg to move upward along the element 16 until latching surface 10b engages the unsupported end of the SME element 16. Movement of the operator 6 to the left will then carry the pivotally supported upper end 8a of movable contact arm 8 across the line of action of spring 12 to effect toggling of the overcenter mechanism and reclosure of the contact 8b upon stationary contact 4b.

The circuit breaker may be selectively operated to its tripped position by operation of the remote control apparatus 32 to a closed condition thereby to connect the SME element in circuit with the electric source. When so connected, current flowing through the element 16 causes direct heating thereof to cause the latter to warp to its right-hand dotted-line position thereby releasing the latch lever 10 and operating the movable contact arm 8 to the tripped position as aforedescribed. Because the SME element is directly heated by current flow in the shunt trip control circuit, much less current is required to heat the element to its transition temperature than was required of the indirect heating provided by the current flow in the distribution circuit.

The foregoing has described a preferred embodiment of an electric circuit breaker which utilizes a shape memory effect element therein as a current sensing trip means and as a shunt trip operating element. It is to be understood that this invention is susceptible of various modifications without departing from the scope of the appended claims.

We claim:

1. A circuit breaker comprising: a single pole molded case of a residential and commercial type having a width of one inch or less;

separable contact means within said case;

means for electrically connecting said contact means in a circuit to be protected by said circuit breaker;

operating means connected to said contact means for operating said contact means between open and closed positions;

latchable means connected with said operating means for enabling said operating means for operation of said contact means in a latched position and for effecting separation of said contacts independently of said operating means in an unlatched position;

current responsive trip means within said case operable for releasing said latchable means in response to predetermined current values in said protected circuit; and means within said case controllable from a remote location for selectively operating said trip means.

2. The invention defined in claim 1 wherein said trip means is thermally operable and said last mentioned means comprises means for heating said trip means independently of current in said protected circuit.

3. The invention defined in claim 2 wherein said trip means comprises shape memory effect (SME) means.

4. The invention defined in claim 3 wherein said means for heating said SME trip means comprises means for directing current independent of current in said protected circuit through said SME trip means.

5. The invention defined in claim 1 wherein said current responsive trip means comprises an element formed of shape memory effect (SME) alloy and means for indirectly effecting heating of said element and said means controllable from a remote location comprises means for directly heating said element.

6. The invention defined in claim 5 wherein said means for indirectly effecting heating of said SME element comprises heater means connected in series circuit with said separable contacts.

7. The invention defined in claim 6 wherein said SME element comprises an elongated member supported at one end thereof and the opposite end of which is operable for releasing said latchable means.

8. The invention defined in claim 7 wherein said one end of said SME element is supported on said heater means.

9. The invention defined in claim 8 wherein said opposite end of said SME element directly engages said latchable means in an intermediate shape of said SME element for restraining said latchable means in said latched position, said opposite end being movable for releasing said latchable means when said SME element is heated beyond a transition temperature thereof causing said SME element to transform to a memory shape.

10. The invention defined in claim 9 wherein said SME element is electrically connected to said heater means and said means for directly heating said element comprises conductor means electrically connected to said element at a location spaced from said connection with said heater means, said conductor means being connectable to remotely located control means for selectively connecting said SME element to a source of electric power.

11. A shunt trip electric circuit breaker comprising, in combination:

separable contacts;

means for connecting said contacts in an electric distribution circuit;

an operating mechanism manually operable for effecting overcenter snap-action of said contacts between separated and closed conditions;

latchable means for enabling said operating means in a latched position and for effecting separation of said contacts independently of said operating means in an unlatched position;

shape memory effect (SME) trip means indirectly heated by current flow in said distribution circuit for releasing said latchable means in response to a predetermined current flow in said distribution circuit; and means for selectively connecting said SME trip means in a control circuit for direct heating by current flow in said control circuit for selectively effecting release of said latchable means.

12. The invention defined in claim 11 wherein said means for selectively connecting said SME trip means in a control circuit comprises:

first conductor means electrically connected to said SME trip means and connectable to a source of electric power; and second conductor means electrically connected to said SME trip means at a point remote from the connection of said first conductor means thereto, said second conductor means being connectable to control apparatus operable in response to an input signal for connecting said SME trip means in circuit with said source.

13. The invention defined in claim 12 wherein said first conductor means comprises a heater element connected in said distribution circuit and said SME trip means comprises an SME element fixedly mounted on said heater element and having a portion projecting therefrom.

14. The invention defined in claim 13 wherein said SME element directly engages said latchable means for restraining the latter in said latched position.

15. The invention defined in claim 14 wherein said SME trip means is formed to have a predetermined movement when heated beyond a transition temperature thereof which is in excess of movement required for releasing said latchable means.

16. The invention defined in claim 15 wherein said projecting portion of said SME element traverses said predetermined movement.

17. The invention defined in claim 15 wherein said projecting portion of said SME element directly engages said latchable means and traverses said predetermined movement 18. The invention defined in claim 13 wherein said second conductor means is electrically connected to said projecting portion.

19. The invention defined in claim 11 wherein said SME trip means is restorable to a position for latching said latchable means upon cooling to a predetermined temperature.

20. The invention defined in claim 19 wherein said SME trip means comprises a two-way SME element which is self-restorable to an original condition from a transition position upon said cooling.

21. The invention defined in claim 19 wherein said SME trip means comprises biasing means for biasing said SME trip means to an original condition from a transition position upon said cooling.

22. A shunt trip electric circuit breaker comprising, in combination:

a stationary contact;

a movable contact;

means for connecting said contacts in an electric distribution circuit;

an overcenter toggle drive spring for moving said movable contact into and out of engagement with said stationary contact;

operating means for manually controlling operation of said drive spring for effecting selective toggling action of said movable contact into and out of engagement with said stationary contact;

latchable means for enabling said operating means and said drive spring in a latched position and for effecting toggling action of said movable contact out of engagement with said stationary contact in an unlatched position;

shape memory effect (SME) trip means responsive to current flow in said distribution circuit for releasing said latchable means; and means for selectively connecting said SME trip means in a control circuit for direct heating by current flow in said control circuit for selectively effecting release of said latchable means.

23. The invention defined in claim 22 wherein said means for selectively connecting said SME trip means in a control circuit comprises conductor means electrically connected to said SME trip means at spaced apart locations and connectable to a source of electric power and to control apparatus operable in response to an input signal for connecting said SME trip means in circuit with said source.

24. The invention defined in claim 23 wherein said SME trip means is indirectly heated by current flow in said distribution circuit.

25. The invention defined in claim 24 wherein said conductor means comprises a heater connected in said distribution circuit and said SME trip means comprises an elongated SME element affixed at one end to said heater, an opposite end of said element projecting away from said heater.

26. The invention defined in claim 25 wherein said conductor means further comprises a flexible conductor electrically connected to said opposite end of said SME element.

27. The invention defined in claim 26 wherein said SME element is formed to have a predetermined movement when heated beyond a transition temperature thereof which is in excess of movement required for releasing said latchable means.

28. The invention defined in claim 27 wherein said SME element directly engages said latchable means for restraining the latter in said latched position.

29. The invention defined in claim 28 wherein said opposite end of said SME element directly engages said latchable means and traverses said predetermined movement.

30. The invention defined in claim 29 wherein said SME element is restorable to a position for latching said latchable means upon cooling to a predetermined temperature.

31. The invention defined in claim 30 wherein said SME element is a two-way element which is self-restorable to an original position from a transition position upon said cooling.

32. The invention defined in claim 30 wherein said SME trip means comprises biasing means for biasing said SME element to an original position from a transition position upon said cooling.

* * * * *